US010760241B2

(12) United States Patent
Wallerand et al.

(10) Patent No.: US 10,760,241 B2
(45) Date of Patent: Sep. 1, 2020

(54) UPGRADING SUBSEA FOUNDATIONS OF MOORING SYSTEMS

(71) Applicant: Acergy France SAS, Suresnes (FR)

(72) Inventors: Regis Wallerand, Versailles (FR); Patrick Chevalier, Rungis (FR)

(73) Assignee: Acergy France SAS, Suresnes (FR)

( * ) Notice: Subject to any disclaimer, the term of this patent is extended or adjusted under 35 U.S.C. 154(b) by 0 days.

(21) Appl. No.: 16/310,405

(22) PCT Filed: Jun. 15, 2017

(86) PCT No.: PCT/IB2017/000933
§ 371 (c)(1),
(2) Date: Dec. 14, 2018

(87) PCT Pub. No.: WO2017/216638
PCT Pub. Date: Dec. 21, 2017

(65) Prior Publication Data

US 2019/0352878 A1 Nov. 21, 2019

(30) Foreign Application Priority Data

Jun. 16, 2016 (GB) ..... 1610516.5

(51) Int. Cl.
*E02D 27/52* (2006.01)
*B63B 21/18* (2006.01)
(Continued)

(52) U.S. Cl.
CPC ..... *E02D 27/52* (2013.01); *B63B 21/18* (2013.01); *B63B 21/26* (2013.01); *B63B 21/50* (2013.01);
(Continued)

(58) Field of Classification Search
CPC ..... B63B 21/50; B63B 21/27; B63B 21/26; B63B 27/10; B63B 2021/003; B63B 21/18; E02D 2250/0053; E02D 27/52
See application file for complete search history.

(56) References Cited

U.S. PATENT DOCUMENTS 3,712,260 A * 1/1973 Mott ..... B63B 21/26 114/230.13
5,061,131 A 10/1991 Petty et al.
(Continued)

FOREIGN PATENT DOCUMENTS

CN 104802934 7/2015
DE 930 199 7/1955
(Continued)

OTHER PUBLICATIONS

Poster entitled "Mooring systems for offshore floating installations: trends and technology," published in Offshore Magazine, Oct. 2013 (www.offshore-mag.com).

*Primary Examiner* — Carib A Oquendo
(74) *Attorney, Agent, or Firm* — Levy & Grandinetti

(57) ABSTRACT

A mooring system has a pre-existing subsea foundation at a first seabed location and a catenary mooring line connected to the pre-existing foundation and extending to a moored floating unit. A supplementary subsea foundation is installed at a second seabed location to upgrade the capacity of the mooring system. The mooring line is connected to the supplementary subsea foundation while the connection between the mooring line and the pre-existing subsea foundation is maintained.

37 Claims, 7 Drawing Sheets

(51) Int. Cl.

| | |
|---|---|
| *B63B 21/26* | (2006.01) |
| *B63B 21/50* | (2006.01) |
| *B63B 27/10* | (2006.01) |
| *B63B 21/00* | (2006.01) |

(52) U.S. Cl.
CPC ..... *B63B 27/10* (2013.01); *B63B 2021/003* (2013.01)

(56) References Cited

U.S. PATENT DOCUMENTS

| | | | | |
|---|---|---|---|---|
| 5,390,618 | A * | 2/1995 | Wolff | B63B 21/50 114/230.23 |
| 6,113,315 | A * | 9/2000 | Fulton | B63B 21/22 114/265 |
| 6,719,496 | B1 * | 4/2004 | Von Eberstein | B63B 21/22 114/296 |
| 7,976,246 | B1 | 7/2011 | Krabbendam | |
| 9,487,272 | B2 * | 11/2016 | Bauer | B63B 21/50 |
| 2007/0017429 | A1 * | 1/2007 | Riggs | B63B 21/50 114/293 |
| 2009/0123235 | A1 | 5/2009 | Maconochie et al. | |
| 2015/0218770 | A1 * | 8/2015 | Arslan | E02B 17/0026 405/211 |

FOREIGN PATENT DOCUMENTS

| | | |
|---|---|---|
| DE | 93 01 099 U1 | 5/1993 |
| WO | WO 94/16936 | 8/1994 |
| WO | WO 2008/129320 | 10/2008 |

* cited by examiner

UPGRADING SUBSEA FOUNDATIONS OF MOORING SYSTEMS

BACKGROUND OF THE INVENTION

This invention relates to retrofitting mooring systems, as used in the subsea oil and gas industry, to upgrade the capacity of their subsea foundations to resist tension in mooring lines.

A poster published in *Offshore Magazine*, October 2013, entitled *Mooring systems for offshore floating installations: trends and technology* provides a comprehensive overview of the mooring technologies known in the art. That poster may be viewed online at http://www.offshore-mag.com/content/dam/offshore/print-articles/Volume%2073/10/MOORING-010814REV.pdf Floating surface units or installations used in oil and gas production are moored to the seabed to remain in substantially the same location for many years of production. An example of such an installation is an FPSO (Floating Production, Storage and Offloading) vessel.

Some taut-leg floating production units are known but these require reinforced anchorages to be installed at the outset, which is generally achieved by injecting concrete or grout. The present invention is concerned with the more common catenary mooring lines that have generally catenary curvature when viewed in profile.

Typically, an FPSO will be held in place by a mooring system comprising catenary-shaped mooring lines arranged in groups to define semi-taut legs. When viewed from above, the mooring lines splay apart from neighbouring mooring lines in each group to define a passive spread pattern.

Usually there is one group of mooring lines at each quadrant of an FPSO, hence a total of four groups, radiating outwardly at 90° intervals when viewed from above. If each of the four groups contains three mooring lines, for example, this is known in the art as a 4×3 pattern. Some surface installations, such as turret-moored vessels, are moored with three groups of mooring lines, radiating outwardly at 120° intervals when viewed from above.

FIGS. 1 and 2 show one of the mooring lines 10 of a conventional mooring system for an FPSO 12 floating at the surface 14, as an example of a moored surface installation. The mooring line 10 hangs with catenary curvature under tension between the FPSO 12 and the seabed 18. Whilst curved, the mooring line 10 lies substantially in a vertical plane.

In this example, the mooring line 10 is anchored by a suction anchor or suction pile 16. Most of the length of the pile 16 is embedded in the soil of the seabed 18 to ensure sufficient resistance to tension in the mooring line 10 when the FPSO 12 moves back.

It will be apparent from FIGS. 1 and 2 that the mooring line 10 is attached to the pile 16 at a level below the mid-point of the length of the pile 16, typically between half and two-thirds of the way down from the top of the pile 16. A similar arrangement is also shown, for example, in WO 02/062653 to a predecessor of the Applicant. This arrangement optimises the balance of forces that act on the pile 16: connecting the mooring line 10 at or nearer to the top would tend to cause rotation of the pile 16, which would require a bigger pile to withstand a given tension in the mooring line 10.

It follows that a short bottom part of the mooring line 10, typically 10 m to 20 m long, is buried in the soil of the seabed 18 beside the pile 16. That buried bottom part is sometimes called a 'forerunner'.

A drag anchor, also embedded in the seabed 18, may be used instead of a pile 16 as a mooring foundation for a surface installation such as an FPSO 12. Again, a short bottom part of the mooring line 10 will similarly be buried in the soil of the seabed 18 if a drag anchor is used.

In more detail, the mooring line 10 comprises, in sequence from bottom to top: a bottom or ground chain 20 attached to the pile 16; a section of spiral strand wire (SSW) 22 attached to the ground chain 20; and a top chain 24 that joins the SSW section 22 to the FPSO 12.

The SSW section 22 will usually be of coated steel but could be of a synthetic plastics material instead: references to 'wire' in this specification are not intended to limit the meaning only to metallic wires.

The SSW section 22 constitutes most of the length of the mooring line 10 because, for a given tensile strength, wire is lighter, more compact to store and less expensive than chain. Chains 20, 24 are used instead of wire at the bottom and top of the mooring line 10 to avoid damage to the wire at those vulnerable locations. As a non-limiting example, the ground chain 20 and the top chain 24 may each be about 200 m long whereas the SSW section 22 may be well over 1200 m long.

Various known connectors 26 join the successive components of the mooring line 10. Different types of connector 26, such as chain connectors and shackles, will typically be used at different locations along the mooring line 10.

It will be apparent from the detail view of FIG. 2 that the ground chain 20 is in two sections, namely a lower section 28 and an upper section 30. Thus, in sequence from the bottom to the top of the mooring line 10: the lower section 28 of the ground chain 20 is attached to a buried side wall of the pile 16; the upper section 30 of the ground chain 20 is connected to the lower section 28 by a first connector 26; the SSW section 22 is connected to the upper section 30 of the ground chain 20 by a second connector 26; and the top chain 24 is connected to the SSW section 22 by a third connector 26.

The lower section 28 of the ground chain 20 is attached to the pile 16 before the pile 16 is overboarded from a surface installation vessel and lowered to penetrate the seabed 18. Thus, the lower section 28 of the ground chain 20 and the first connector 26 are buried under the seabed 18 as part of the bottom 'forerunner' part of the mooring line 10.

The upper section 30 of the ground chain 20 extends from the buried first connector 26 beneath the seabed 18 to the second connector 26 above the seabed 18, where it joins the SSW section 22. Thus, a short transitional portion of the upper section 26 of the ground chain 20 lies on or close to the seabed 18.

A drawback of the partially-buried ground chain 20 arises from inevitable movement of the ground chain 20, in use, relative to the surrounding soil of the seabed 18. For example, all parts of the mooring line 10, including the ground chain 20, will move in response to motion of the FPSO 12 under wind and wave action. Similarly, all parts of the mooring line 10 will be moved by other seawater dynamics acting on the mooring system, such as ocean currents, especially in deeper water.

The resulting movements of the ground chain 20 also move the adjacent soil of the seabed 18. Over time, this may create a trench without soil around and above the previously-buried part of the ground chain 20 beside the pile, hence potentially reducing the capacity of the pile 16. Similarly, a drag anchor could slip and lose its intended position. The result is that, after several years, the actual capacity of the foundation may be significantly lower than was originally intended.

In other cases, the tension applied by a mooring line to a foundation may be greater than was originally intended. For example, the floating surface installation may be enlarged or a mooring line handling system may be upgraded.

For these reasons, it may be necessary to upgrade the capacity of a subsea foundation from time to time. Upgrading capacity may involve recovering original capacity that has been lost by a foundation over time. Alternatively, or additionally, upgrading capacity may involve improving the original capacity of a foundation.

Conventionally, upgrading the capacity of a subsea foundation involves installing a new, more efficient foundation in the seabed near the old foundation. Next, part of the mooring line is disconnected from the old foundation to reconnect it to the new foundation. The old foundation is then redundant.

Disconnecting a mooring line from an existing foundation, or even slackening a mooring line to reduce tension, disadvantageously increases the load on other parts of the mooring system. It is a lengthy and costly operation that introduces a risk of the surface installation losing its position, especially if sea conditions deteriorate during the operation.

WO 2008/129320, to a predecessor of the Applicant, discloses a frame that is used for connecting mooring line elements on the seabed. In a reverse operation, the frame can also be used to separate mooring line elements. The frame comprises pulling means to connect mooring line elements. However, the mooring line elements cannot have residual tension in them. Thus, the frame of WO 2008/129320 cannot be used on a live tensioned line; a line from the floating surface installation must first be slackened.

U.S. Pat. No. 5,061,131 discloses an alternative approach involving extra weights that sharply increase mooring resistance in the event of extreme drift. However, the possible size of such weights is limited on a permanent mooring and in any event would not provide a sufficient upgrade in tension-resisting capacity. Also, the weights apply a permanent shear stress to the mooring lines.

WO 94/16936 relates to a twin-anchor mooring arrangement for a floating vessel, in which a first drag anchor is attached at an end of a mooring line and a second drag anchor is slidable along the mooring line to a second anchoring position.

US 2009/123235 relates to a pile anchor system for an offshore structure. The system includes an original pile attached to a mooring line, and a supplementary pile installed in the vicinity of the original pile. The supplementary pile is attached to the original pile by means of a coupling member, but is not attached to the mooring line itself.

U.S. Pat. No. 7,976,246 describes a system for creating a deep water mooring spread by successively installing independent suction piles from a floating vessel.

BRIEF SUMMARY OF THE INVENTION

Against this background, the invention provides a method of upgrading the capacity of a mooring system, which system comprises a pre-existing subsea foundation at a first seabed location and a mooring line, which may be catenary-shaped, connected to the pre-existing subsea foundation and extending to a moored floating unit. The method comprises: installing a supplementary subsea foundation at a second seabed location, which may be spaced across the seabed from the first seabed location; and connecting the mooring line to the supplementary subsea foundation while maintaining the connection between the mooring line and the pre-existing subsea foundation.

A portion of the mooring line may be displaced at the second seabed location to make space for installing at least part of the supplementary subsea foundation. The displaced portion of the mooring line can then be moved into connection with at least part of the supplementary subsea foundation.

For example, the displaced portion of the mooring line may be lifted away from the seabed. In that case, at least part of the supplementary subsea foundation may be moved to a position beneath the displaced portion of the mooring line, for example by effecting translational movement of that part across the seabed or by lifting that part across the seabed. Before that, at least part of the supplementary subsea foundation may be lowered to a seabed location beside the mooring line. In another approach, the displaced portion of the mooring line may be diverted around the second seabed location and laid on the seabed.

Preferably, a frame of the supplementary subsea foundation is placed on the seabed; one or more foundation elements are embedded in the seabed and coupled to the frame; and the mooring line is connected to the frame. For example, a foundation element may be coupled to the frame by installing that foundation element into or through a guide structure provided in or attached to the frame. Another approach is to place a link between the frame and the foundation element, where the foundation element is embedded in the seabed and spaced apart from the frame.

Advantageously, the mooring line is placed between first and second laterally-spaced foundation elements.

A frame of the supplementary subsea foundation may be coupled with a foundation element of the supplementary subsea foundation pre-installed at the second seabed location. For example, the frame may be lowered onto the foundation element, such as onto the top of a pile.

If the supplementary subsea foundation is a pile, the mooring line may be connected to the pile via a connection mechanism integrated with the pile.

After installation of the supplementary subsea foundation is complete, the surface installation may continue to be moored using the existing subsea foundation and the supplementary subsea foundation in combination to resist tension in the mooring line without disconnecting the line from either foundation.

Preferably, a chain section of the mooring line is connected to the supplementary subsea foundation by clamping the chain section or by mechanically engaging links of the chain section. More generally, the mooring line is advantageously connected to the supplementary subsea foundation by embracing the mooring line.

The inventive concept extends to a related mooring system that comprises: a first subsea foundation at a first seabed location; a mooring line, which may be catenary-shaped, connected to the first subsea foundation and extending to a moored floating unit; and a supplementary subsea foundation at a second seabed location, connected to the mooring line by a remotely-operable mechanical connector.

The mechanical connector preferably embraces the mooring line and may connect the supplementary subsea foundation to a chain section of the mooring line by clamping the chain section or by engaging links of the chain section.

Advantageously, the mechanical connector defines an upwardly-opening receptacle to receive the mooring line.

The supplementary subsea foundation suitably comprises: a frame supporting the connector; and one or more foundation elements embedded in the seabed and coupled to the frame, for example via a guide structure provided in or attached to the frame or via a link extending between the frame and the or each foundation element, which foundation element is embedded in the seabed and spaced apart from the frame.

An interface may be provided on top of at least one foundation element and/or beneath the frame for coupling the frame to the foundation element. In another approach, the supplementary subsea foundation is a pile and the connector is integrated with the pile.

A supplementary subsea foundation for use in the mooring system of the invention comprises: a frame; a remotely-operable mechanical connector supported by the frame, which connector is arranged to connect with a mooring line; and at least one foundation element attachable to or integrated with the frame, arranged to be embedded in seabed soil.

The invention therefore provides a back-up or auxiliary mooring system that reinforces an existing mooring system without having to disconnect the mooring line. The invention embodies the principle of installing a subsea structure on the seabed near the existing mooring line, which is then lifted and connected to the structure. The subsea structure may be integrated with or attached directly to an anchoring foundation, such as a suction pile, or may be installed separately and anchored by driven piles to form a hybrid foundation anchor.

In summary, the invention provides a method and apparatus for upgrading the capacity of a catenary mooring line under tension, without disconnecting the line from its existing subsea foundation. This saves time and cost and reduces the risk of the anchored vessel drifting. The existing foundation remains connected to the mooring line during the upgrading operation and so remains available to restrain motion of the vessel.

The use of a supporting frame rather than a simple mechanical connection advantageously limits lateral motion of the part of the mooring line that is embedded in the seabed soil. The reduced lateral motion of the buried line portion reduces the trenching effect and so delays any additional loss of resistance to tension in the line.

The apparatus of the invention is designed to be installed and actuated in deep water from the surface, using known and readily-available means such as cranes and ROVs.

Embodiments of the invention provides a method to upgrade the resistance capacity of a mooring system. The method comprises: vertically lifting the mooring line near an initial foundation; inserting a supporting frame below a lifted section of the mooring line; releasing the vertical lift on the mooring line and mechanically connecting the frame to the mooring line; and coupling at least one additional foundation to the frame.

Embodiments of the invention also provide a device to upgrade the resistance capacity of a mooring system. The device comprises: a supporting frame inserted between the mooring line and the seabed; a remotely-actuated mechanical connector for connecting the mooring line to the supporting frame; and at least one additional foundation coupled to the supporting frame.

The additional foundation may comprise one or more piles, such as suction piles, gravity piles, pin piles or driven piles. Other forms of additional foundation are possible, preferably embedded foundations such as drag anchors.

At least one pair of additional foundations may be used, one foundation on each side of the mooring line. Thus, one foundation of each pair is preferably on a respective side of the mooring line.

Additional foundations such as piles may be inserted in slots, openings or guide tubes of, in or attached to the supporting frame. In another approach, additional foundations may be coupled to the frame by mooring line elements such as chains or wires, for example spiral strand wire.

Where an additional foundation is a suction pile, the top of the suction pile may serve as the supporting frame. The mooring line is suitably lifted aside during installation of the frame/pile. Mechanical connection between the mooring line and the frame/pile may be effected via a recess in the frame/pile.

The supporting frame may be arranged to lie on the seabed, for example taking the form of a generally flat mat or mudmat. Such a mudmat may have a peripheral skirt to engage with the seabed soil or may have sled formations designed to slide over the seabed, at least in an installation direction intersecting the general plane of the mooring line.

The additional foundation can be installed in or on the seabed before or after the frame. However it is preferred to install the additional foundation after the frame because it may be more challenging to position and couple the frame to a pre-installed foundation.

Mechanical connection between the frame and the mooring line may, for example, be effected by a chain stopper or by a clamp.

To illustrate the prior art background, reference has already been made to FIGS. 1 and 2 of the accompanying drawings.

Figure 1:
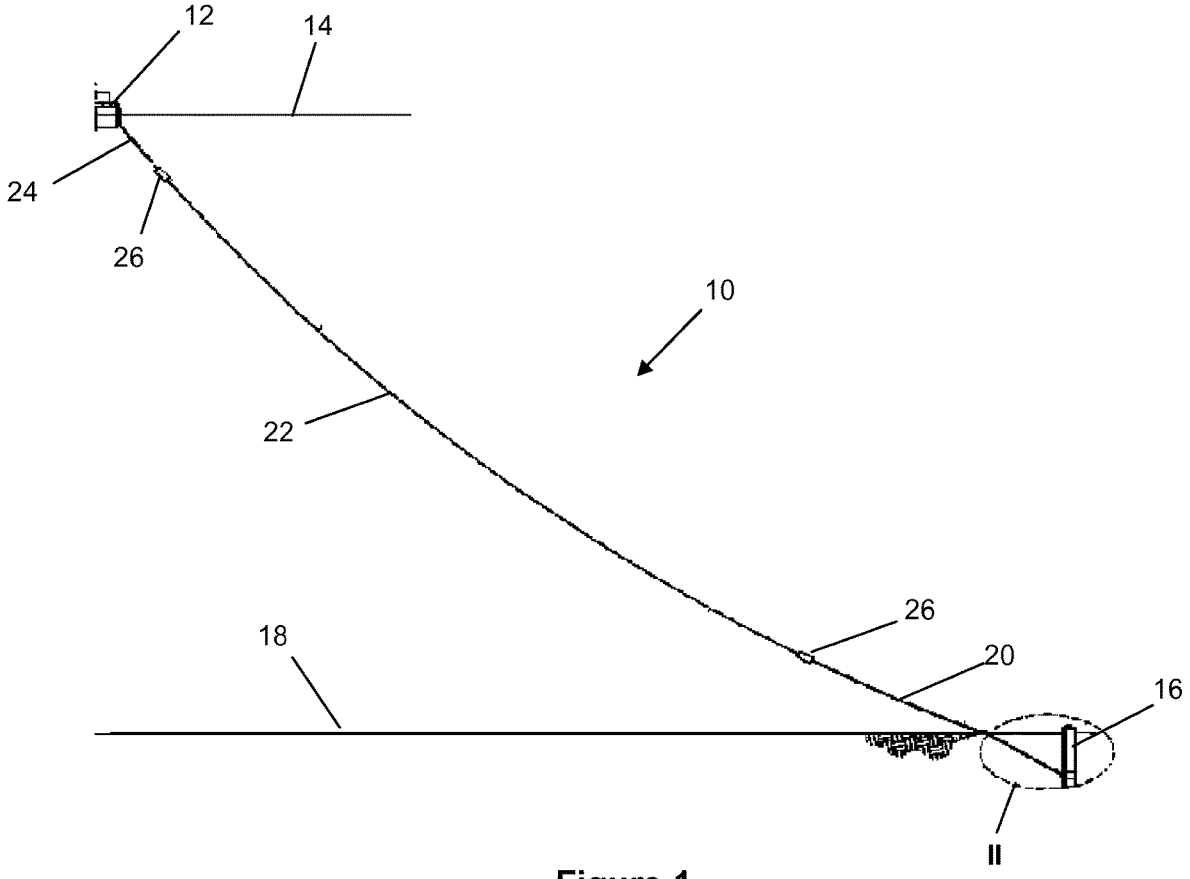
Figure 1 PRIOR ART
FIG. 1 is a side view of a mooring line extending from a moored surface vessel to a suction pile.
Figure 2:
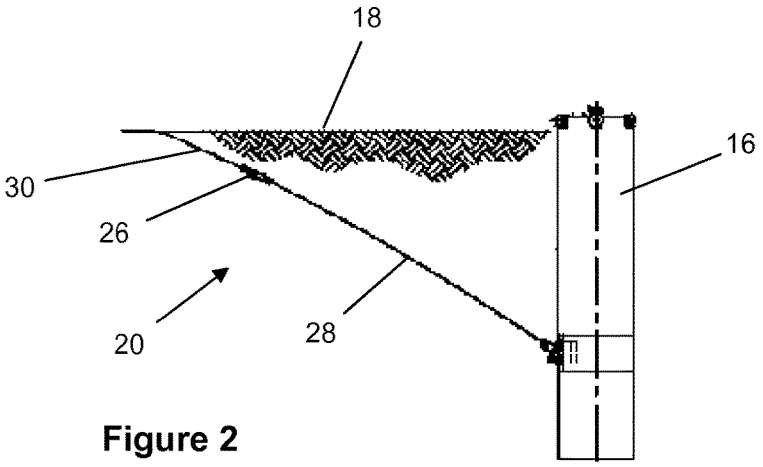
Figure 2 PRIOR ART
FIG. 2 is an enlarged detailed view of the ground chain end of the mooring line and the pile, corresponding to Detail II of FIG. 1.
Figure 3:
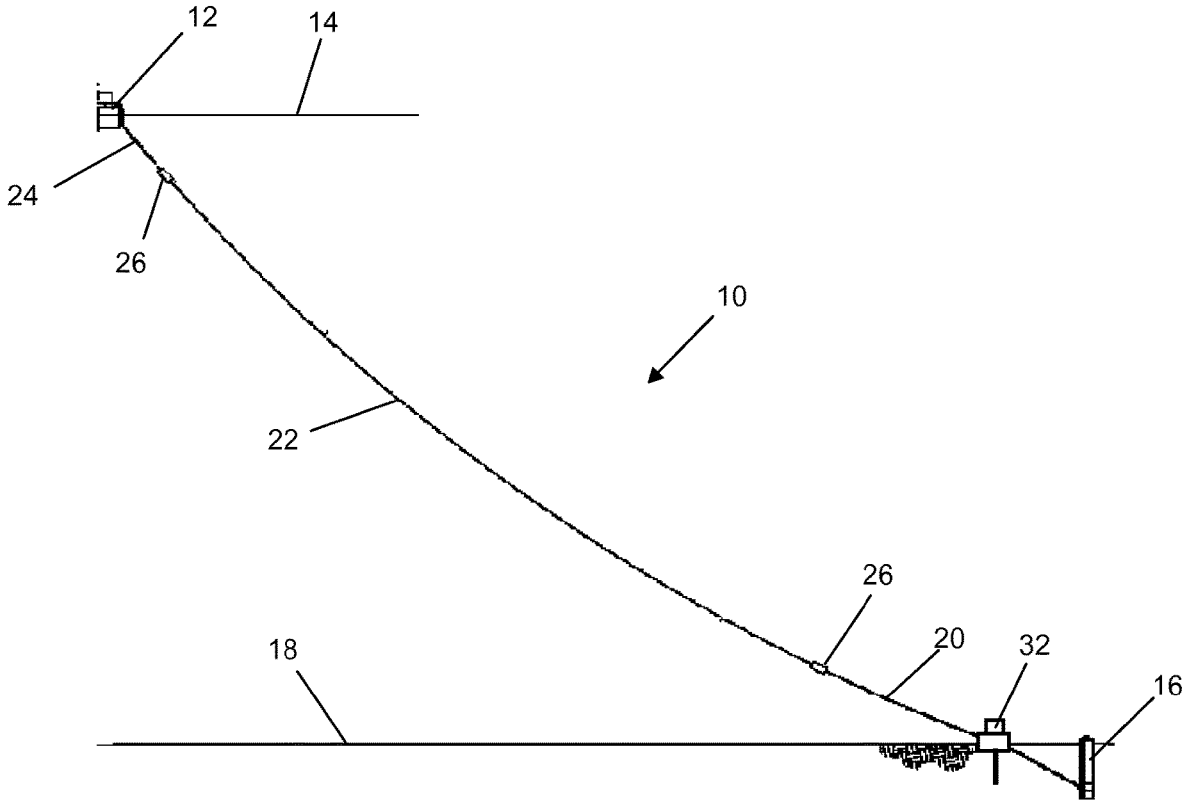
Figure 4:
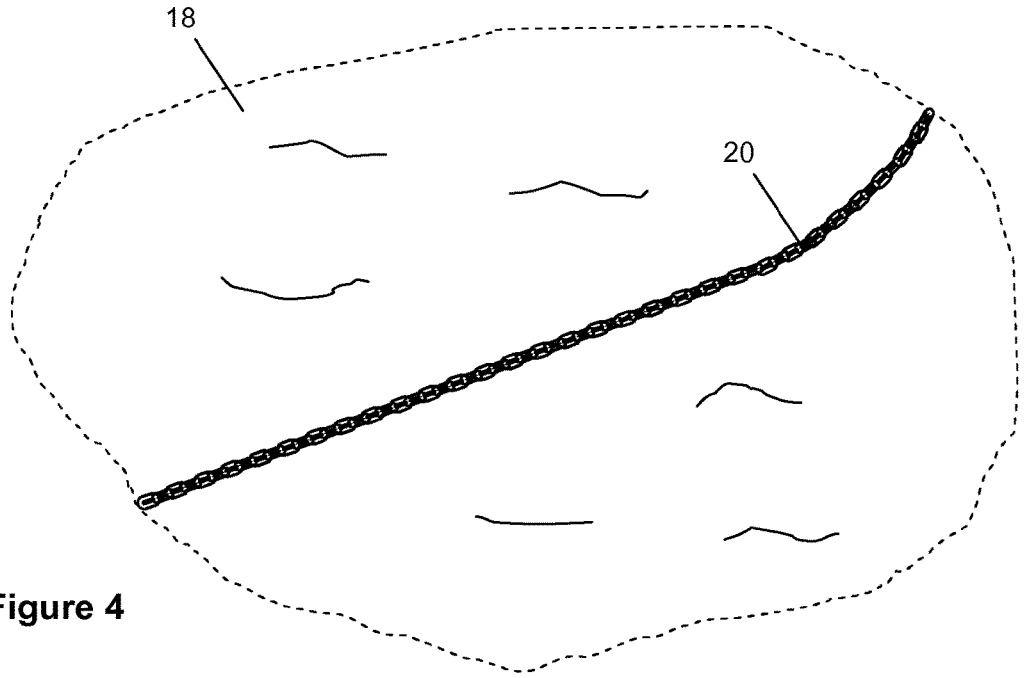
Figure 5:
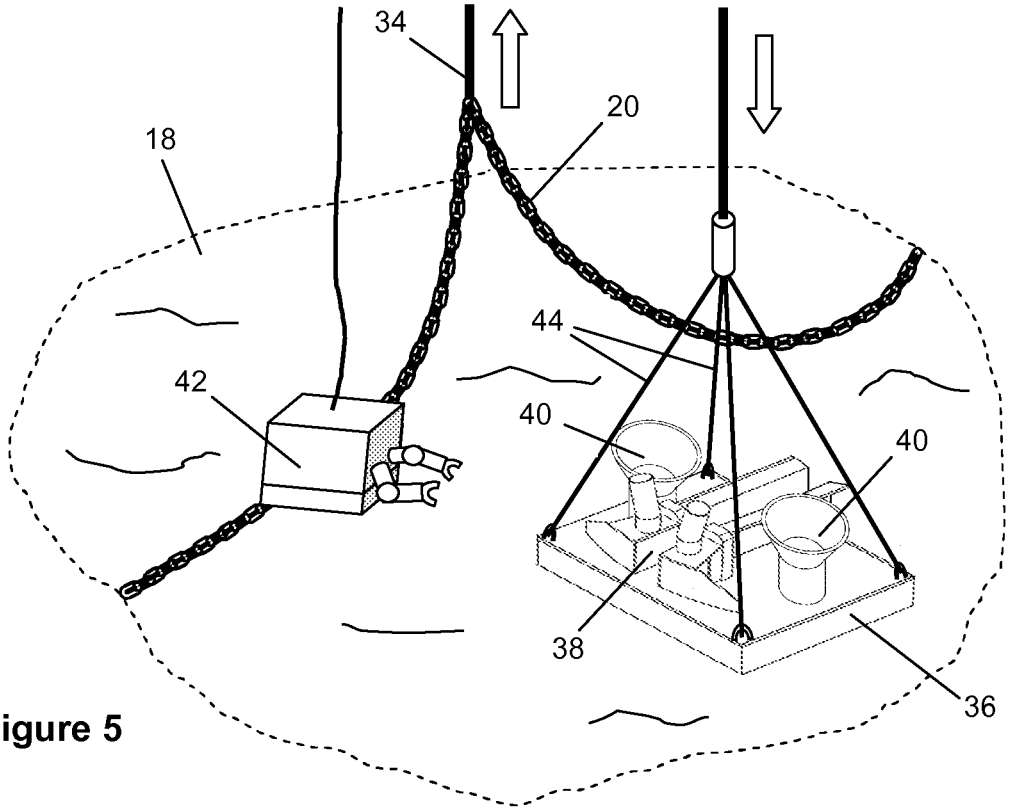
Figure 6:
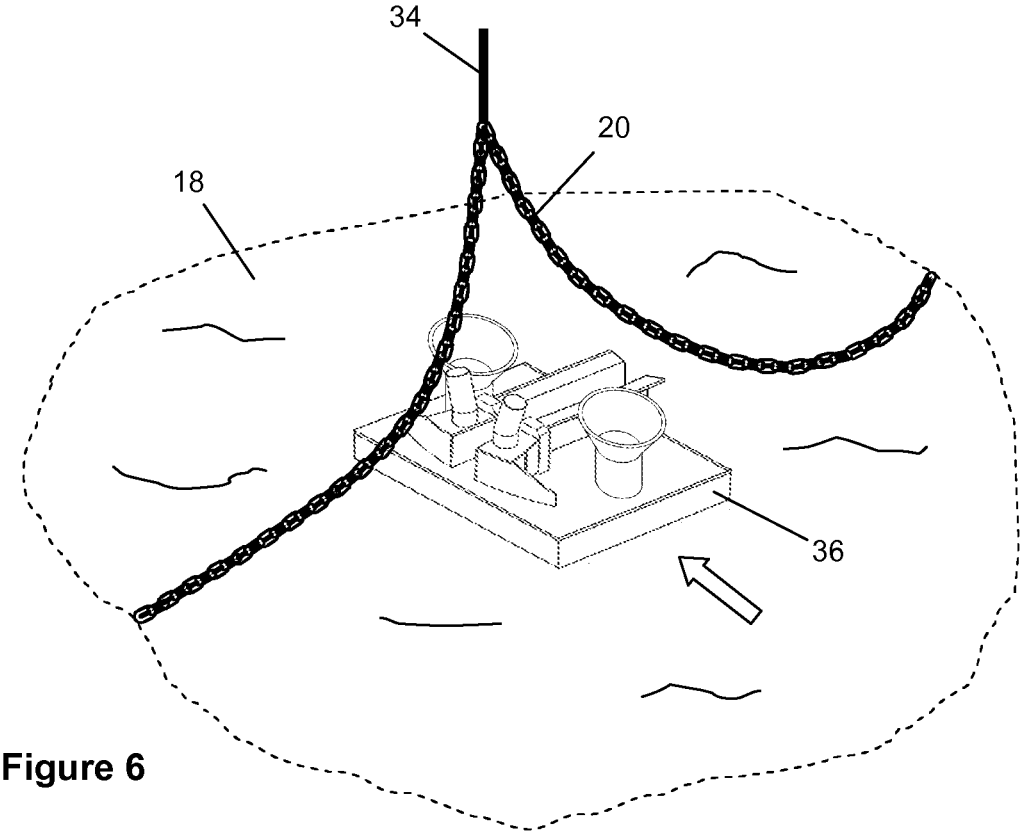
Figure 7:
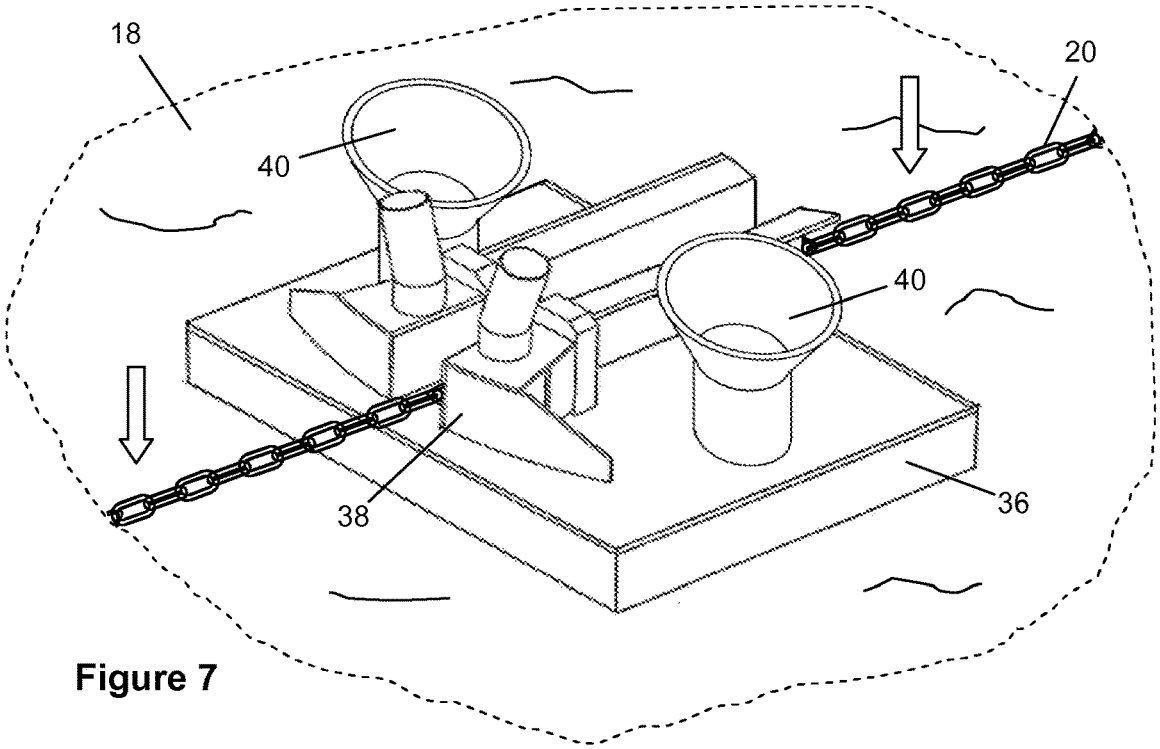
Figure 8:
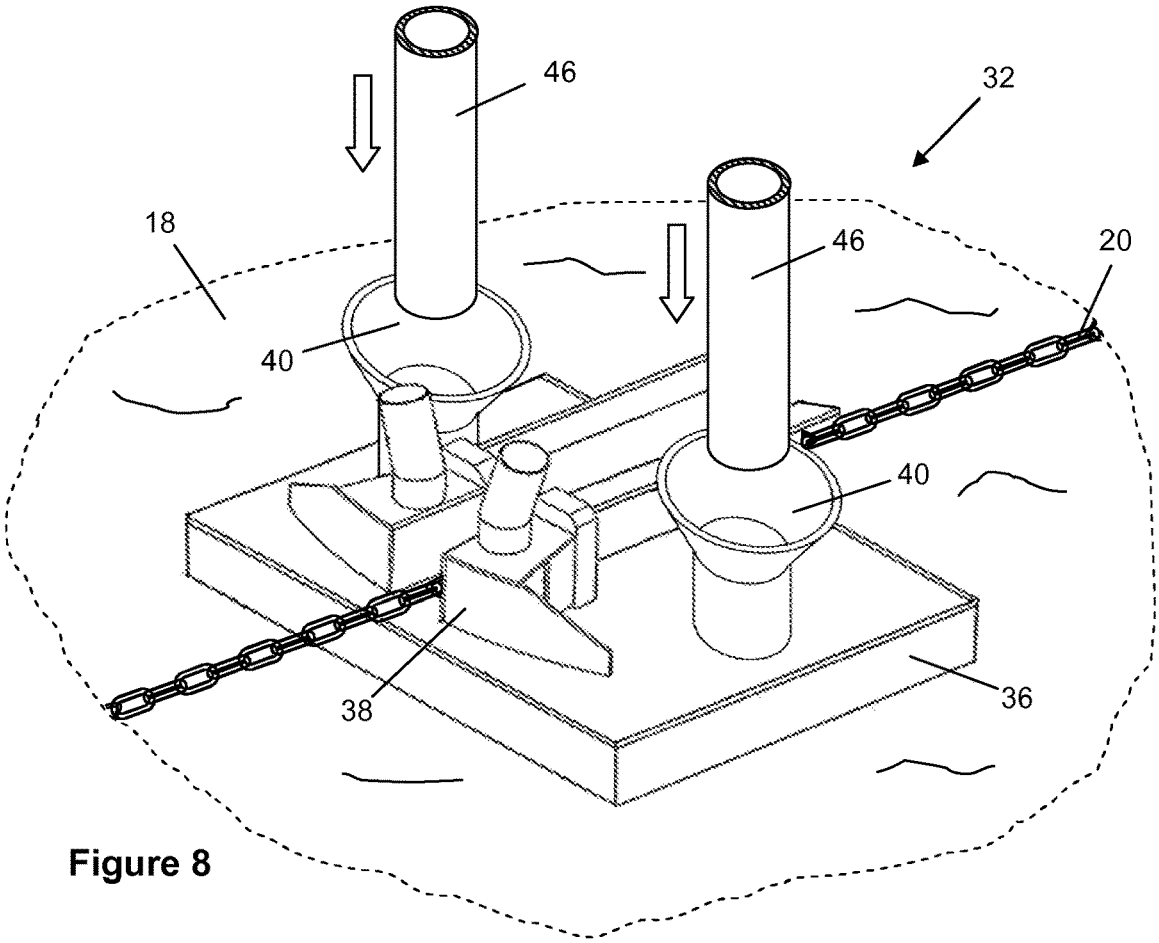
Figure 9:
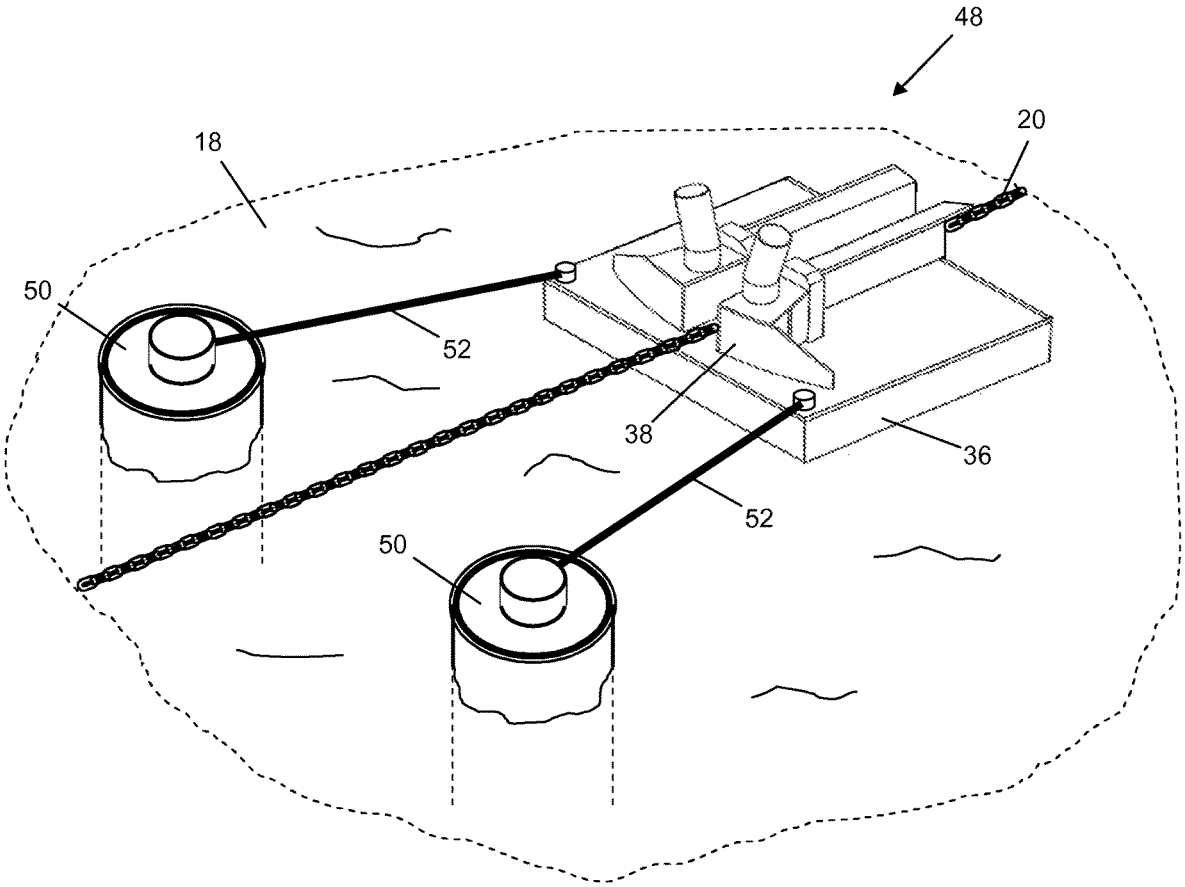
Figure 10:
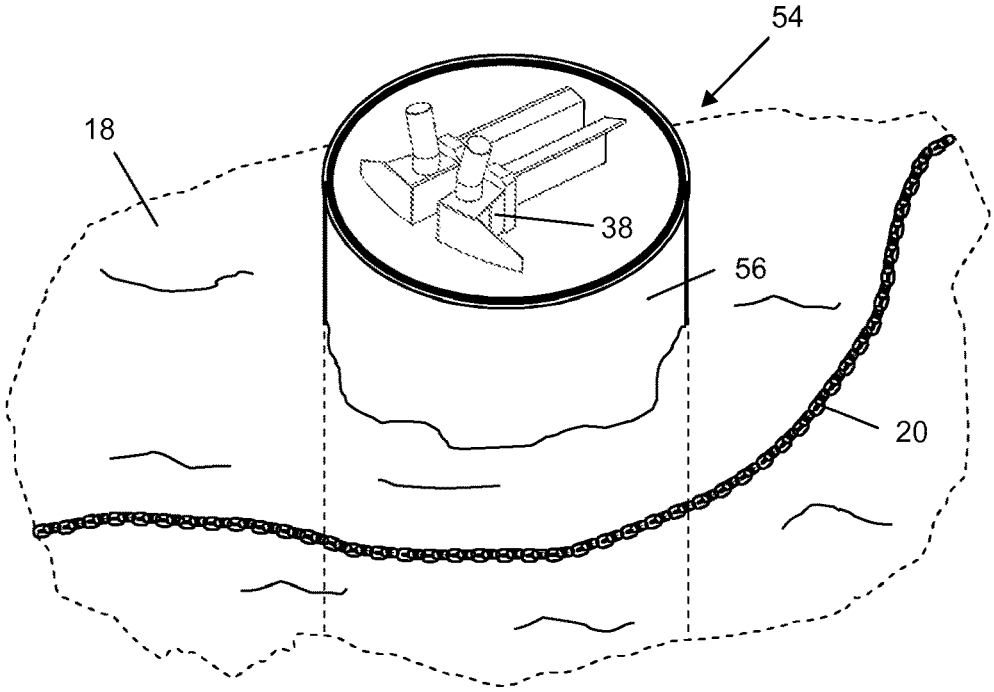
Figure 11:
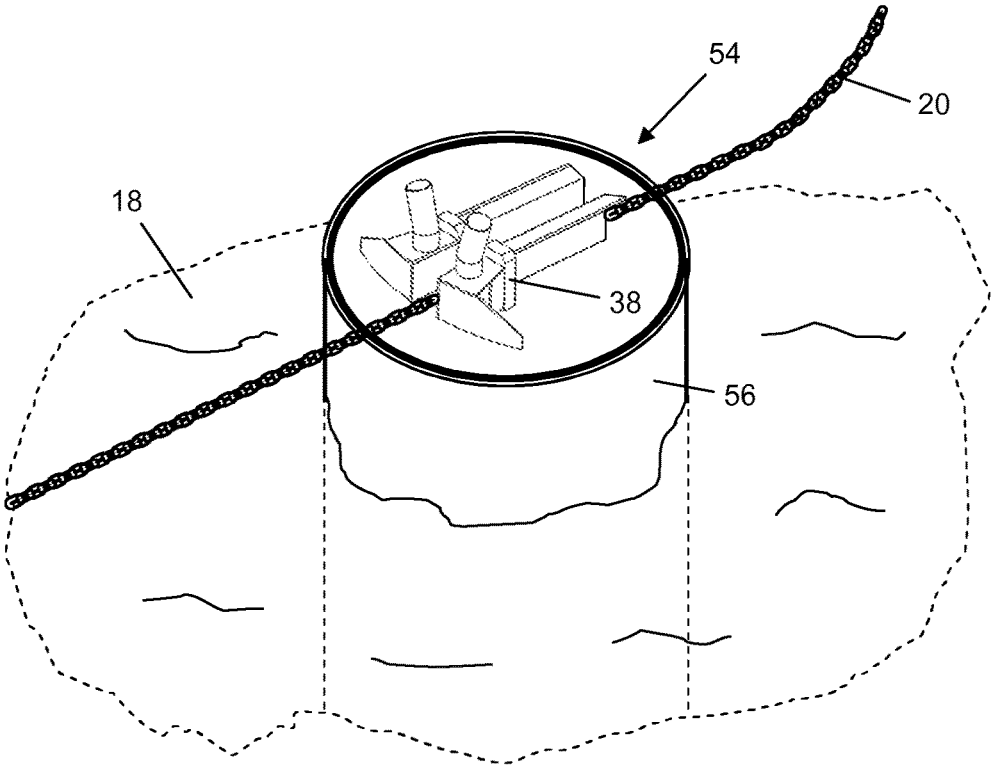
Figure 12:
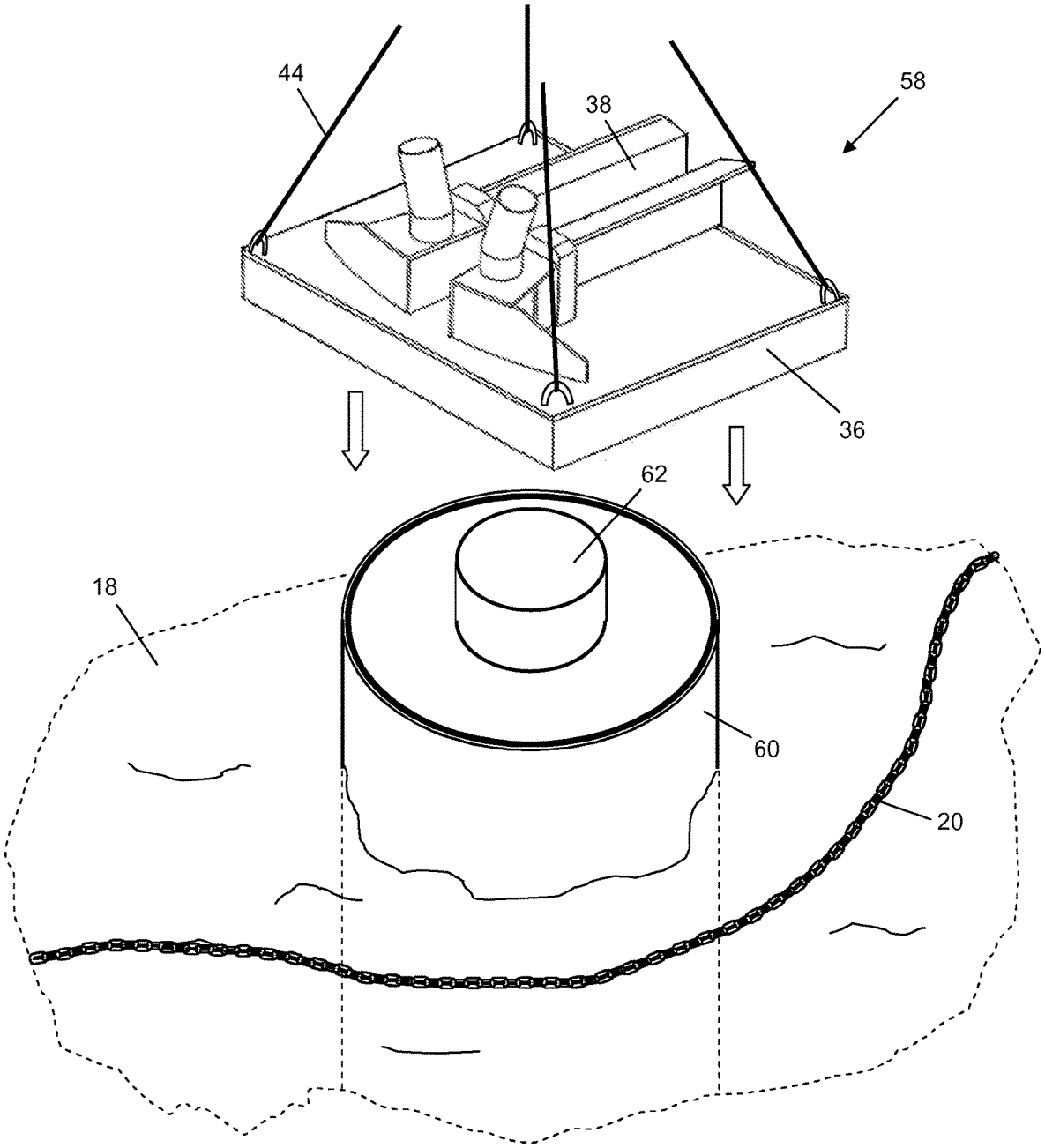

In order that the invention may be more readily understood, reference will now be made, by way of example, to the remainder of the drawings in which:

FIG. 3 is a side view of a mooring line corresponding to FIG. 1 but with the addition of a supplementary foundation interposed between the FPSO and the suction pile in accordance with the invention;

FIG. 4 is a schematic perspective view of a ground chain of a mooring line on the seabed before the addition of a supplementary foundation in accordance with the invention;

FIG. 5 corresponds to FIG. 4 but shows the ground chain lifted above the seabed and a support frame placed on the seabed beside the ground chain;

FIG. 6 corresponds to FIG. 5 but shows the support frame moved laterally across the seabed to lie under the still-lifted ground chain;

FIG. 7 is an enlarged schematic perspective view of the support frame of FIG. 6 with the ground chain now lowered into engagement with a chain stopper mechanism on the support frame;

FIG. 8 corresponds to FIG. 7 but shows the addition of piles that pin the frame to the seabed to complete the supplementary foundation of the invention;

FIG. 9 is a schematic perspective view of a second embodiment of the invention in which the supplementary foundation of the invention is completed by anchoring a support frame carrying a chain stopper mechanism to piles that are remote from the support frame;

FIG. 10 is a schematic perspective view of a third embodiment of the invention in which a support frame carrying a chain stopper mechanism is integrated with a pile to form a supplementary foundation, the ground chain being diverted laterally from its normal route to make space for installing the pile;

FIG. 11 corresponds to FIG. 10 but shows the ground chain moved into engagement with the chain stopper mechanism on the pile; and FIG. 12 is a schematic perspective view of a fourth embodiment of the invention in which a support frame carrying a chain stopper mechanism is being connected to a pre-installed pile.

DETAILED DESCRIPTION OF THE SEVERAL VIEWS OF THE DRAWINGS

Referring firstly to FIG. 3, this largely corresponds to FIG. 1 and therefore like numerals are used for like parts. Here, a supplementary foundation 32 that supports the mooring line 10 in accordance with the invention is shown interposed between the FPSO 12 and the suction pile 16. The supplementary foundation 32 engages the ground chain 20 of the mooring line, where the ground chain 20 crosses or lies on the seabed 18.

Thus, the pile 16 and the supplementary foundation 32 cooperate with each other to resist tension in the mooring line 10. In other words, the supplementary foundation 32 adds to the capacity of the pile 16 to upgrade the overall capacity of the mooring system. Importantly, this upgrade is achieved without disconnecting the mooring line 10 from the pile 16. Movement of the FPSO 12 is restrained continuously by the mooring line 10 throughout.

Advantageously, the lowermost portion of the mooring line 10 between the pile 16 and the supplementary foundation 32, including the portion that is buried in the soil of the seabed 18, is restrained against movement by the supplementary foundation 32. The supplementary foundation 32 also isolates that portion of the mooring line 10 from movement of the remainder of the mooring line 10. Thus, the capacity of the pile 16 will no longer degrade significantly due to trenching effects. The upper portion of the mooring line 10 between the supplementary foundation 32 and the FPSO 12 can, of course, continue to move but its amplitude of lateral motion is restricted. In any event, movement of the upper portion of the mooring line 10 takes place largely above the seabed 18, where it cannot give rise to a trenching effect.

FIGS. 4 to 8 illustrate one way in which the supplementary foundation 32 of FIG. 3 may be installed in accordance with the invention.

FIG. 4 shows a portion of the ground chain 20 of the mooring line 10 lying on the seabed 18. Part of the catenary curvature of the mooring line 10 between the FPSO 12 and the seabed 18 is evident on the right side of FIG. 4, where the ground chain 20 rises above the seabed 18. The pile 16 to which the ground chain 20 is attached is not shown but will lie to the left of the portion of the ground chain 20 shown in FIG. 4, at the end of a further portion of the ground chain 20 buried in the seabed 18.

FIG. 5 shows a mid-point of the ground chain 20 lifted from and held above the seabed 18 by a wire 34 that hangs from a surface support vessel (not shown). The wire 34 suitably hangs from a winch on the vessel, such as an abandonment and recovery (A&R) winch, but could instead hang from a crane on the vessel.

In FIG. 5, the surface support vessel has also lowered a frame 36 onto the seabed 18 in a holding location beside the raised portion of the ground chain 20. The frame 36 carries a connection mechanism 38 that is arranged to grip or engage the ground chain 20. The connection mechanism 38 may, for example, employ the principle of a clamp or a chain stopper as disclosed in CN 104802934. In this example, the frame 36 also carries one or more guide tubes 40 to receive pin piles, as will be described more fully with reference to FIG. 8 of the drawings.

The frame 36 is suitably lowered from a crane on the surface support vessel but could instead hang from a winch on the vessel. An ROV 42 is shown in attendance to monitor the operation and to disconnect slings 44 that support the frame 36.

In FIG. 6, the ground chain 20 is still held above the seabed 18 by the wire 34 but the frame 36 has now been moved across the seabed 18 to lie under the raised portion of the ground chain 20. The direction of movement of the frame 36 is transverse to, preferably substantially orthogonal to, the general plane of the mooring line 10 so as to intersect that plane.

This translational, generally horizontal movement of the frame 36 could be achieved by using the crane on the surface support vessel to lift the frame 36 from the holding location on the seabed 18. In that case, the ROV 42 shown in FIG. 5 can, if needs be, disconnect and reconnect slings 44 to avoid the slings 44 clashing with the raised portion of the ground chain 20. Another approach is to slide the frame 36 across the seabed 18 like a sled into its final position under the ground chain 20.

The enlarged view of FIG. 7 shows the ground chain 20 now lowered into, and engaged with, with the connection mechanism 38 on the frame 36. The connection mechanism 38 defines an upwardly-opening receptacle for this purpose. The connection mechanism 38 embraces and receives the ground chain 20.

Finally, as shown in FIG. 8, pin piles 46 are inserted into the guide tubes 40 on the frame 36 to secure the frame 36 to the seabed 18. This completes the supplementary foundation 32 as also shown in FIG. 3.

The connection mechanism 38 is operable remotely to connect the ground chain 20 to the supplementary foundation 32. The connection mechanism 38 clamps the ground chain 20 or engages links of the ground chain 20 in the manner of a chain stopper.

The FPSO 12 remains moored thereafter using the pile foundation 16 and the supplementary foundation 32 in combination to resist tension in the mooring line 10 without disconnecting the line 10 from either foundation 16, 32. The line 10 remains connected to both foundations 16, 32 thereafter and may remain so connected at least until the whole mooring system is eventually decommissioned. This may therefore be for longer than a moored FPSO 12 or other surface installation remains on station, which could be for more than twenty years.

Turning next to FIG. 9, this shows a supplementary foundation 48 in a second embodiment of the invention, being a variant of the first embodiment shown in FIGS. 3 to 8. In this variant, a frame 36 supports a connection mechanism 38 as before but the guide tubes 40 are omitted. Instead, the frame 36 is anchored by remote foundation elements that are exemplified here as piles 50 but could take other forms such as drag anchors. The frame 36 is connected to the piles 50 by respective tensile links 52, which could be of chain or wire.

Preferably, as shown in FIG. 9, the ground chain 20 is placed between laterally-spaced foundation elements such as the piles 50. This balances forces on the system while leaving space for installing the piles 50 without having to divert the ground chain 20 laterally as shown in the next embodiments.

FIGS. 10 and 11 show a supplementary foundation 54 in a third embodiment of the invention, in which a connection mechanism 38 is integrated with a foundation member. The foundation member is exemplified here as a suction pile 56. In effect, the top of the pile 56 is equivalent to the frame 36 of the preceding embodiments.

FIG. 10 shows the ground chain 20 pulled laterally across the seabed 18 to allow space for installation of the pile 56 along the normal route of the ground chain 20. Once the pile 56 has been installed in the seabed 18, the ground chain 20 is lifted into engagement with the connection mechanism 38 as shown in FIG. 11.

Finally, FIG. 12 shows a supplementary foundation 58 in a fourth embodiment of the invention, in which a frame 36 that supports a connection mechanism 38 can be mounted to a pre-installed pile 60 via an interface structure 62. Like FIG. 10, the ground chain 20 extending across the seabed 18 is shown here diverted to allow space for installation of the pile 60 along the normal route of the ground chain 20.

As in the first embodiment, the frame 36 is suitably lowered from a crane on a surface support vessel but could instead hang from a winch on the vessel. An ROV like that shown in FIG. 5 can monitor the operation and then disconnect slings 44 that support the frame 36.

Once the frame 36 has been mounted onto the pile 60 via the interface structure 62, the ground chain 20 is lifted into engagement with the connection mechanism 38 in a similar way to the arrangement shown in FIG. 11.

Many variations are possible without departing from the inventive concept. For example, the principle of the invention could be used when mooring a unit that floats at a subsea location rather than at the surface, such as a subsea buoy.

The invention claimed is:

1. A method of upgrading a mooring system capacity that comprises a pre-existing subsea foundation at a first seabed location and a mooring line connected to the pre-existing subsea foundation and extending to a moored floating unit, the method comprising:

installing a supplementary subsea foundation at a second seabed location; and connecting the mooring line to the supplementary subsea foundation by engaging the mooring line with the supplementary subsea foundation while maintaining the connection between the mooring line and the pre-existing subsea foundation.

2. The method of claim 1, comprising displacing a portion of the mooring line at the second seabed location to make space for installing at least part of the supplementary subsea foundation.

3. The method of claim 2, comprising lifting the displaced portion of the mooring line away from the seabed.

4. The method of 3, comprising moving at least part of the supplementary subsea foundation to a position beneath the displaced portion of the mooring line.

5. The method of claim 4, preceded by lowering at least part of the supplementary subsea foundation to a seabed location beside the mooring line.

6. The method of claim 4, comprising effecting translational movement of at least part of the supplementary subsea foundation across the seabed.

7. The method of claim 4, comprising lifting at least part of the supplementary subsea foundation across the seabed.

8. The method of claim 2, comprising diverting the displaced portion of the mooring line around the second seabed location and laying that displaced portion of the mooring line on the seabed.

9. The method of claim 2, comprising moving the displaced portion of the mooring line into connection with at least part of the supplementary subsea foundation.

10. The method of claim 1, comprising placing a frame of the supplementary subsea foundation on the seabed, embedding one or more foundation elements in the seabed, coupling the or each foundation element to the frame and connecting the mooring line to the frame.

11. The method of claim 10, comprising coupling the or each foundation element to the frame by installing the or each foundation element into or through a guide structure provided in or attached to the frame.

12. The method of claim 10, comprising placing a link between the frame and the or each foundation element, which foundation element is embedded in the seabed and spaced apart from the frame.

13. The method of claim 10, comprising placing the mooring line between first and second laterally-spaced foundation elements.

14. The method of claim 1, comprising coupling a frame of the supplementary subsea foundation with a foundation element of the supplementary subsea foundation pre-installed at the second seabed location.

15. The method of claim 14, comprising lowering the frame onto the foundation element.

16. The method of claim 1, wherein the supplementary subsea foundation is a pile, the method comprising connecting the mooring line to the pile via a connection mechanism integrated with the pile.

17. The method of claim 1, comprising continuing to moor the surface installation using the existing subsea foundation and the supplementary subsea foundation in combination to resist tension in the mooring line without disconnecting the line from either foundation.

18. The method of claim 1, wherein the second seabed location is spaced across the seabed from the first seabed location.

19. The method of claim 1, wherein a chain section of the mooring line is connected to the supplementary subsea foundation by clamping the chain section or by mechanically engaging links of the chain section.

20. The method of claim 1, wherein the mooring line is connected to the supplementary subsea foundation by embracing the mooring line.

21. A mooring system, comprising:

a first subsea foundation at a first seabed location;

a mooring line connected to the first subsea foundation and extending from the first subsea foundation to a moored floating unit; and a supplementary subsea foundation at a second seabed location, connected to the mooring line by a remotely-operable mechanical connector that engages the mooring line.

22. The mooring system of claim 21, wherein the mechanical connector connects the supplementary subsea foundation to a chain section of the mooring line by clamping the chain section or by engaging links of the chain section.

23. The mooring system of claim 21, wherein the mechanical connector embraces the mooring line.

24. The mooring system of claim 21, wherein the mechanical connector defines an upwardly-opening receptacle to receive the mooring line.

25. The mooring system of claim 21, wherein the supplementary subsea foundation comprises:

a frame supporting the connector; and one or more foundation elements embedded in the seabed and coupled to the frame.

26. The mooring system of claim 25, wherein the or each foundation element is coupled to the frame via a guide structure provided in or attached to the frame.

27. The mooring system of claim 25, comprising a link between the frame and the or each foundation element, which foundation element is embedded in the seabed and spaced apart from the frame.

28. The mooring system of claim 25, wherein the mooring line extends between first and second laterally-spaced foundation elements.

29. The mooring system of claim 21, comprising an interface on top of at least one foundation element and/or beneath the frame for coupling the frame to the foundation element.

30. The mooring system of claim 21, wherein the supplementary subsea foundation is a pile and the connector is integrated with the pile.

31. A supplementary subsea foundation for use with a first subsea foundation, the supplementary subsea foundation, comprising:

a frame;

a remotely-operable mechanical connector supported by the frame, which connector is arranged to engage a mooring line that extends from the first subsea foundation to a moored floating unit; and at least one foundation element attachable to or integrated with the frame, arranged to be embedded in seabed soil.

32. The foundation of claim 31, wherein the mechanical connector is arranged to connect the supplementary subsea foundation to a chain section of the mooring line by clamping the chain section or by engaging links of the chain section.

33. The foundation of claim 31, wherein the mechanical connector is arranged to embrace the mooring line.

34. The foundation of claim 31, wherein the mechanical connector defines an upwardly-opening receptacle to receive the mooring line.

35. The foundation of claim 31, comprising a guide structure provided in or attached to the frame for attachment of the or each foundation element to the frame.

36. The foundation of claim 31, comprising a tensile link between the frame and the or each foundation element, which foundation element is spaced apart from the frame.

37. The foundation of claim 31, wherein the frame is attached to the foundation element by an interface above the foundation element and beneath the frame.

* * * * *